US005857379A

United States Patent [19]

Lulofs et al.

[11] Patent Number: 5,857,379

[45] Date of Patent: Jan. 12, 1999

[54] HAIR-CARE APPLIANCE WITH HAIR-MOISTNESS MEASUREMENT BY MEASURING THE RESISTANCE OF THE HAIR, AND CIRCUIT FOR CONVERTING THE RESISTANCE VALUE OF A RESISTOR INTO A MEASUREMENT SIGNAL

[75] Inventors: Klaas J. Lulofs; Petrus J. Bremer, both of Drachten, Netherlands

[73] Assignee: U.S. Philips Corporation, New York, N.Y.

[21] Appl. No.: 712,028

[22] Filed: Sep. 11, 1996

[30] Foreign Application Priority Data

Sep. 13, 1995 [EP] European Pat. Off. ..... 95202484

[51] Int. Cl.[6] ..... G01N 25/56

[52] U.S. Cl. ..... 73/73; 73/865.8; 324/694; 324/696; 219/222; 132/212

[58] Field of Search ..... 73/73, 865.8, 866; 324/691, 694, 696; 132/212, 271; 34/50, 96, 46; 219/222

[56] References Cited

FOREIGN PATENT DOCUMENTS 126943 7/1984 Japan .
38463 2/1992 Japan .
193203 7/1992 Japan .
197306 7/1992 Japan .
336002 11/1992 Japan .

OTHER PUBLICATIONS

Oliver et al. "Electronic Measurements and Instrumentation", 1971, pp. 276–279.

*Primary Examiner*—Hezron Williams
*Assistant Examiner*—Nashmiya Fayyaz
*Attorney, Agent, or Firm*—Ernestine C. Bartlett

[57] ABSTRACT

A hair-care appliance measures the moistness of the hair by measuring the resistance ($R_x$) of the hair between measurement electrodes (14A/14B). The hair resistance ($R_x$) is included in a T network comprising a first resistor (20) driven by a voltage source (28) and a second resistor (24). The signal current ($I_s$) through the second resistor is measured and converted into a measurement signal (MS) by a converter (30). As a result of the use of the T network a comparatively large resistance variation of the hair resistance ($R_x$) is required for a given amplitude variation in the signal current ($I_s$). This allows measurements over a wider resistance range while the resolution is maintained.

13 Claims, 5 Drawing Sheets

HAIR-CARE APPLIANCE WITH HAIR-MOISTNESS MEASUREMENT BY MEASURING THE RESISTANCE OF THE HAIR, AND CIRCUIT FOR CONVERTING THE RESISTANCE VALUE OF A RESISTOR INTO A MEASUREMENT SIGNAL

FIELD OF THE INVENTION

The invention relates to a hair-care appliance comprising: hair-styling means; an electric heating element for heating the hair-styling means; electrodes which enter into contact with the hair to be groomed during use of the hair-care appliance; and a measurement circuit, electrically connected to the electrodes for measuring a resistance value between the electrodes and for converting the resistance value into a measurement signal.

The invention also relates to a measurement circuit for measuring a resistance.

BACKGROUND OF THE INVENTION

Such a hair-care appliance is known from U.S. Pat. No. 4,877,042. A hair-care appliance is to be understood to mean an electrically heated device, which may or may not incorporate a blower, for curling, shaping or styling the hair. Such appliances include a hair brush, a hair curler and hair comb without blower, and a hair dryer and hot air brush with blower. Grooming the hair is often effected by first moistening the hair and then shaping it into the desired style with the styling means of the hair-care appliance, in combination or not in combination with a comb or curlers. The hair is dried by the heat of the heating element, for which care must be taken that the hair cannot become too dry because dry hair is more liable to be damaged. For this purpose, the known hair-care appliance comprises electrodes which contact the hair and a measurement circuit which measures the resistance of the hair. The resistance of the hair depends on the moistness of the hair. Dry hair has a comparatively high resistance and wet hair has a comparatively low resistance. The resistance variation is fairly large and therefore it is quite difficult to determine when the resistance passes a certain threshold, so as to allow signalling that the moistness of the hair has reached the desired value.

SUMMARY OF THE INVENTION

It is an object of the invention to provide a hair-care appliance with an accurate moistness measurement of the hair. To this end the hair-care appliance of the type defined in the opening paragraph is characterized in that the measurement circuit comprises: a voltage source connected between a first terminal and a first electrode of said electrodes; a first resistor connected between the first terminal and a second electrode of said electrodes; a second resistor connected between the second electrode and a second terminal; and a converter for converting a signal current through a current path from the second terminal to the first electrode into the measurement signal.

The first resistor, the second resistor and the resistance of the hair between the electrodes form a T network energized by the voltage source. The signal current through the second resistor flows into the converter, which converts it into a suitable measurement signal. The signal current through the second resistor is a fraction of the current through the first resistor, because part of it is shunted by the hair resistance between the electrodes. The advantage of this configuration is that the dynamic range of the signal current is reduced. A comparatively large variation in the hair resistance produces a comparatively smaller signal current variation. As a result, measurement is possible over a larger resistance range with the same resolution. In order to preclude electrolysis in the hair and corrosion of the electrodes it is preferred to use alternating voltages and alternating currents. The T network reduces the impedance level of the measurement circuit, which renders the measurement circuit more immune to spurious signals, particularly as a result of capacitive coupling to the electric mains.

As is known from said United States patent, the measurement signal supplied by the converter can be employed to warn the user that the hair becomes too dry by means of a sound signal. However, it is not unlikely that the user does not respond or responds too late. In order to mitigate this problem, an embodiment of the hair-care appliance is characterized in that the hair-care appliance further comprises means for comparing the measurement signal with a reference signal, and means for turning off the heating element in response to the comparison. As soon as the desired moistness is reached the heating is turned off so as to preclude overheating. In the case of hair-care appliances having a blower it is then also possible to switch off the blower. However, for a better fixation of the hair it is advantageous to blow with cold air for a while. In order to signal to the user that enough cold air has been applied, a further embodiment of the hair-care appliance is characterized in that the hair-care appliance comprises a timer for supplying an activation signal to a signalling device after the heating element has been turned off. If desired, the activation signal can then also turn off the blower.

The voltage source and the converter can be of any desired type. An embodiment of the hair-care appliance is characterized in that the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

The integrator and the comparator together with the T network form a resistance-to-frequency converter, the output of the comparator also serving as the alternating voltage source for the T network. The inverting input of the differential amplifier of the integrator receives the signal current via the second resistance. In the case of moist hair the resistance between the electrodes is low and the signal current is small. It then takes a comparatively long time before the output signal of the integrator reaches the reference voltage and the voltage on the comparator output changes over. After the change-over the direction of the signal current is reversed and the output voltage of the integrator will increase in the opposite direction until the reference voltage is reached again. The third and the fourth resistor produce hysteresis in the comparator, as a result of which the output voltage of the integrator has to assume two different levels in order to cause the comparator to change over. Owing to the comparatively small signal current to the integrator in the case of moist hair, the frequency at which the comparator Output changes over is relatively low. In the case of dry hair the hair resistance is high and the signal current is large. The change-over frequency is then comparatively high.

In order to enable a given moistness of the hair to be signalled and the heating element to be switched off, a frequency measurement is necessary, the frequency of the output signal being compared with a reference frequency. For this purpose, an embodiment of the hair-care appliance is characterized in that the means for comparing comprise: a first monostable multivibrator having an Output and having a trigger input coupled to the output of the comparator; a second monostable multivibrator having an output and having a trigger input coupled to the output of the first monostable multivibrator; and the means for turning off the heating element comprise: an electronic switch having a main current path in series with the heating element and having a control input coupled to the output of the second monostable multivibrator.

In the case of a high frequency the first monostable multivibrator is triggered so frequently that the output remains at a given direct voltage. The second monostable multivibrator is then not triggered. From a given low frequency the output temporarily assumes another value and the second monostable multivibrator is then triggered. The output signal of the second multivibrator indicates whether the frequency is above or below a given value and this signal controls an electronic switch which turns on and turns off the heating element.

The circuit for measuring the hair resistance can also be used for measuring other resistance values, for example those of NTC and PTC resistors in thermostats, light-sensitive resistors in lighting switches, i.e. for uses where a resistance variation is to be monitored.

BRIEF DESCRIPTION OF THE DRAWINGS

These and other aspects of the invention will be described and elucidated with reference to the accompanying drawings, in which.

In these Figures like parts bear the same reference symbols.

DETAILED DESCRIPTION OF THE PREFERRED EMBODIMENTS

Figure 1:
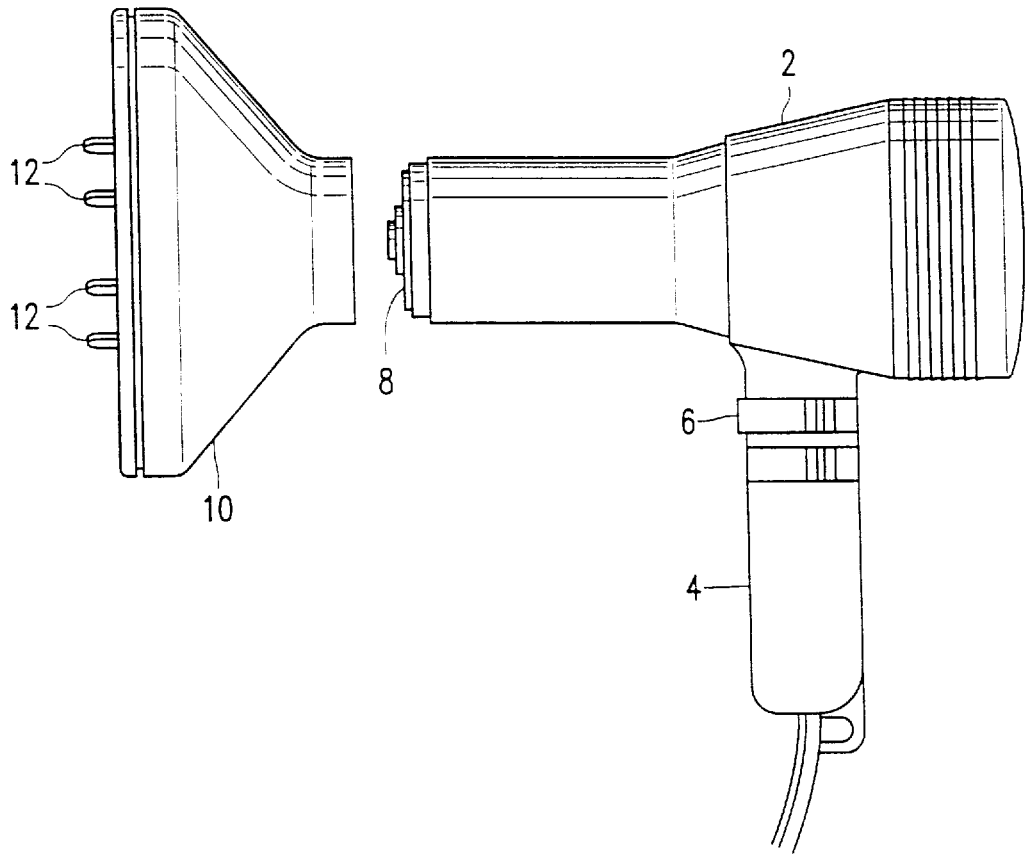
FIG. 1 shows a hair-care appliance with hair moisture measurement in accordance with the invention.
Figure 2:
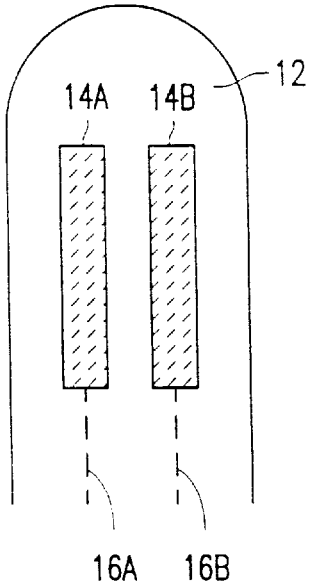
FIG. 2 shows measurement electrodes for measuring the hair moistness.
Figure 3:
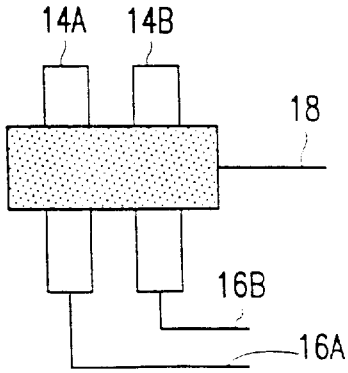
FIG. 3 shows measurement electrodes in contact with a hair.

FIG. 1 shows a hair-care appliance, particularly a hair dryer. The hair dryer has a housing 2 with a handle 4 provided with a control switch 6. The housing accommodates (not shown) a heating element, a blower and actuation, measurement and control electronics with an associated power supply. The air drawn in by the blower and, if applicable, heated by the heating element emerges from the housing via an outlet 8, onto which a diffuser 10 can be fitted to spread the air. The diffuser 10 has diffuser tips 12, which come into contact with the hair to be dried during use of the hair dryer. As is shown in FIG. 2, one or more of the diffuser tips 12 carry electrodes 14A/14B, which by means of connection wires **16A/16*b*, concealed in the diffuser tips 12 and the diffuser 10, are connected to corresponding connection wires in the housing 8. The electrodes 14A/14B can be made of any suitable material, for example copper foil. During use the electrodes 14A/14B are in contact with a hair 18, as is shown in FIG. 3. Instead of or in addition to the diffuser tips 12 electrodes may be arranged at suitable locations on the outlet 8** to allow the hair dryer to be used without a diffuser.

Instead of the hair dryer shown in FIG. 1 the hair-care appliance may be a hot air brush, where hot air emerges from a brush. In that case the electrodes are arranged at suitable points of the brush structure. Also in the case of hair-care appliances without a blower, such as an electrically heated hair curler or hair comb, the electrodes are arranged at locations where the hair to be groomed comes into contact with the appliance.

Figure 4:
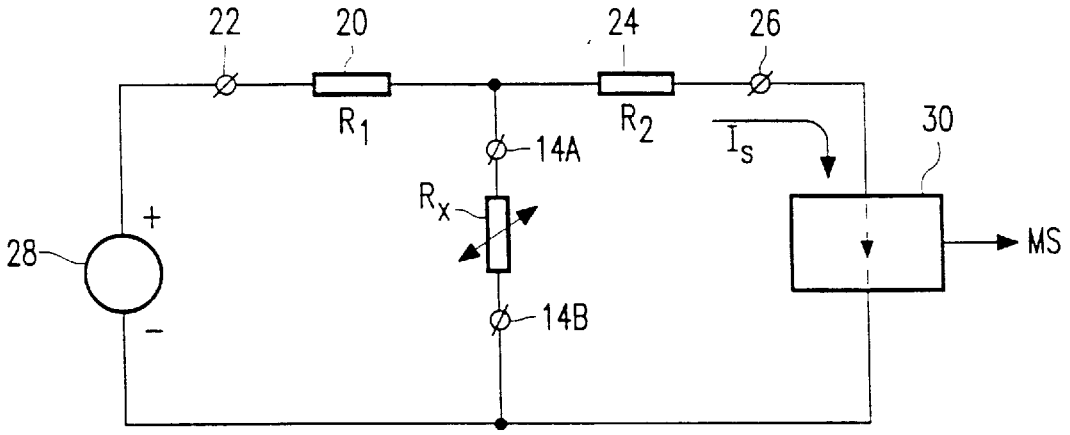
FIG. 4 shows a basic diagram of a hair resistance measuring device in a hair-care appliance in accordance with the invention.

The moistness of the hair is determined by measuring the resistance of the hairs which are in contact with the electrodes 14A/14B. Wet hair has a comparatively low resistance and dry hair has a comparatively high resistance. FIG. 4 shows the basic diagram of the resistance measuring device. The hair resistance $R_x$ to be measured between the electrodes 14A and 14B is included in a T network, which further comprises a first resistor 20 connected between a first terminal 22 and the electrode 14A, and a second resistor 24 connected between the electrode 14A and a second terminal 26. A voltage source 28 is connected to the first terminal 22 and the electrode 14B and a converter 30 is connected to the second terminal 26 and the electrode 14B. The voltage source 28 supplies a current to the T network, a part of which current, i.e. the signal current $I_s$ to be measured, flows through a current path which extends from the second terminal 26 to the electrode 14B via the converter 30. In order to preclude electrolysis of the hair and corrosion of the electrodes 14A/14B the voltage source 28 is preferably a source with an a.c. component, which component is used for the measurement of the hair resistance. For this purpose, a coupling capacitor can be arranged in series with one of the electrodes 14A/14B to block the d.c. component. The converter 30 converts the signal current $I_s$ into a measurement signal MS which is a measure of the resistance $R_x$ of the hair.

The operation of the converter 30 can be based on a measurement of the voltage across a resistance in series with the second resistor 24 and a comparison of the measured voltage with a reference voltage which has been determined by experiment and which corresponds to a given degree of moistness of the hair. A measurement based on the current $I_s$ is to be preferred because of the lower impedance level at the second terminal 26. The T network configuration reduces the impedance level between the voltage source 28 and the second terminal 26, as a result of which spurious signals, particularly those resulting from capacitive coupling between the mains voltage and the second terminal 26, have less effect. A suitable choice of the resistance value $R_1$ for the first resistor 20 and of the resistance value $R_2$ for the second resistor 24 reduces the dynamic range of the signal current $I_s$. This means that a comparatively large variation in the resistance value $R_x$ produces a comparatively small variation in the signal current $I_s$. The resistance value $R_x$ should vary to a comparatively greater extent for a given variation in the signal current $I_s$ than in the case that the resistance $R_x$ to be measured had been arranged directly between the voltage source 28 and the second terminal 26. By including the resistance $R_x$ to be measured in a T network a large resistance range can be measured without loss of resolution and, in addition, the susceptibility to spurious signals is reduced.

Figure 5:
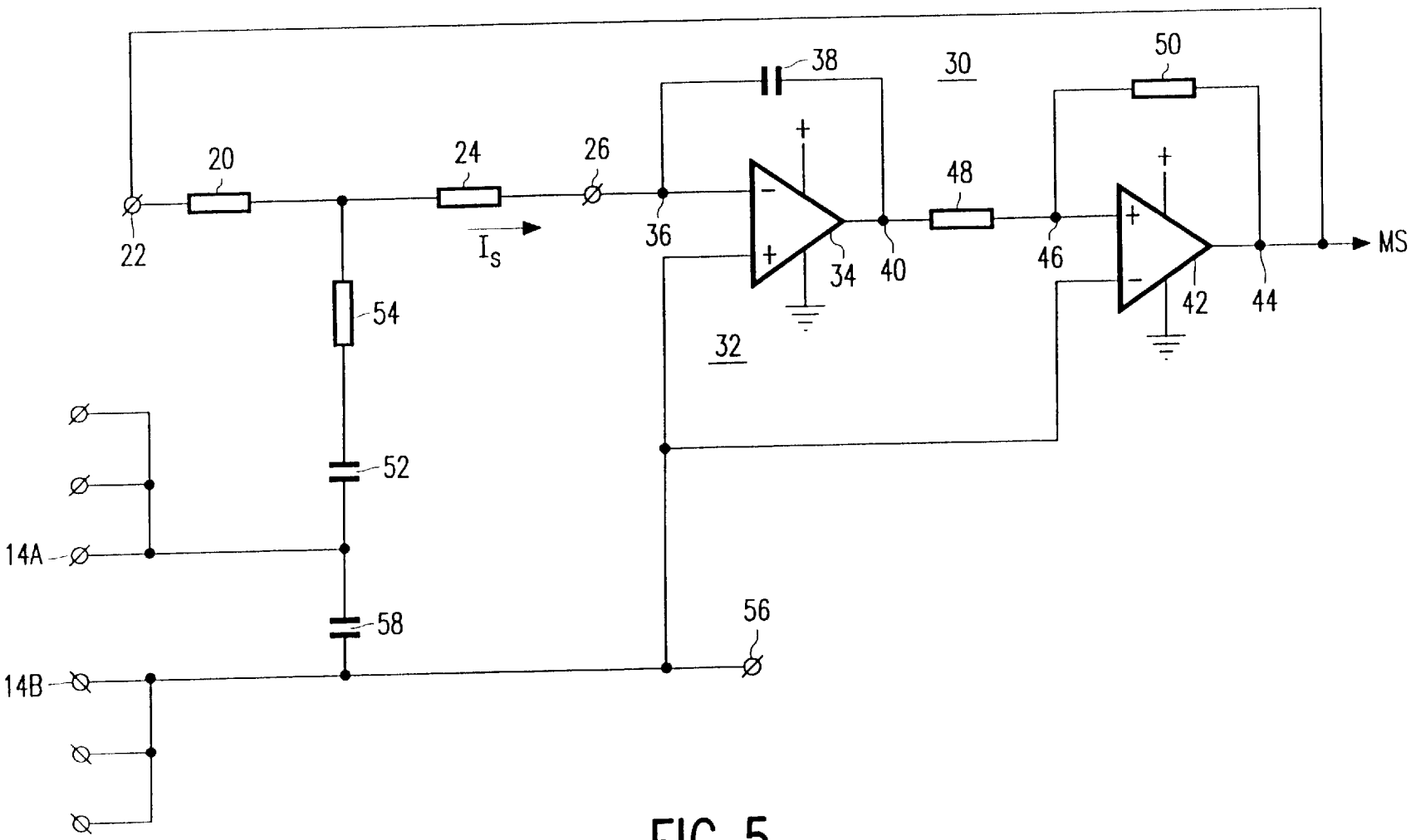
FIG. 5 shows a part of a circuit diagram of an embodiment of a haircare appliance in accordance with the invention.

FIG. 5 shows a more detailed diagram of the converter 30. The values given for the resistors and capacitors and the type numbers of the electronic devices are merely given by way of illustration and example. The converter is a resistance-to-frequency converter comprising an integrator 32 formed by a differential amplifier 34 of the type TLC 252, having an inverting input 36 coupled to the second terminal 26 of the T network, and a 10 nF capacitor 38 connected between an output 40 of the differential amplifier 34 and the inverting input 36. The converter 30 further comprises a comparator 42, also of the type TLC 252, having an Output 44 connected to the first terminal 22 of the T network, and a non-inverting input 46, which is coupled to the output 40 of the differential amplifier 34 via a 33 kΩ resistor 48 and to the output 44 of the comparator 42 via a 47 kΩ resistor 50, which output supplies the measurement signal MS. The other inputs of the differential amplifier 34 and the comparator 42 are connected to a reference voltage terminal 56, connected for example to half the supply voltage of the differential amplifier 34 and the comparator 42.

The electrode 14A is connected to the resistors 20 and 24 of the T network, which resistors both have a value of 470 kΩ, via a 1 μF coupling capacitor 52 and a 10 kΩ resistor 54. The electrode 14B is connected to the reference voltage terminal 56. A 470 pF interference suppression capacitor 58 is arranged across the electrodes 14A and 14B.

Figure 6:
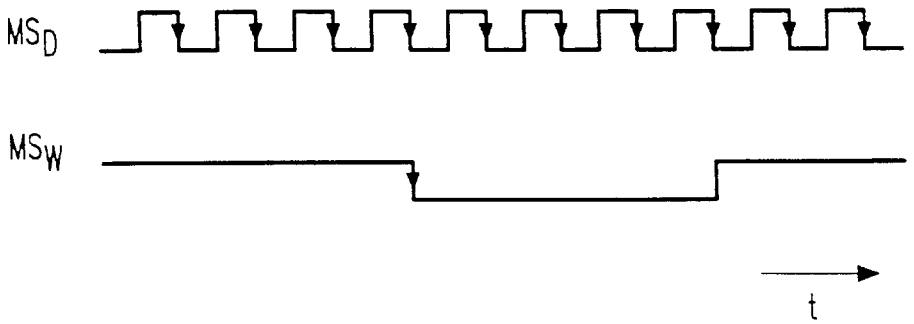
FIG. 6 shows waveform diagrams of signals appearing in an embodiment of a hair-care appliance in accordance with the invention.

The integrator 32 and the comparator 42 together with the T network form a resistance-to-frequency converter, the output 44 of the comparator 42 also forming the a.c. source for the T network. The signal current $I_s$ through the resistor 24 flows into the inverting input 36 of the differential amplifier 34. In the case of moist hair the resistance between the electrodes 14A/14B is low and the signal current $I_s$ is small. It then takes a comparatively long time before the output signal of the integrator 32 reaches the reference voltage on the reference voltage terminal 56 and the measurement signal MS on the comparator output 44 changes over. After the change-over the direction of the signal current $I_s$ is is reversed and the output voltage of the integrator 32 will increase in the opposite direction until the reference voltage is reached again. The resistor 48 and the resistor 50 produce hysteresis in the comparator 42, as a result of which the output voltage of the integrator 32 has to assume two different levels in order to cause the comparator 42 to change over. Owing to the comparatively small signal current $I_s$ to the integrator in the case of moist hair, the frequency at which the measurement signal MS changes over is relatively low and the measurement signal will have a waveform as shown at $MS_W$ in FIG. 6. In the case of dry hair the hair resistance is high and the signal current $I_s$ is large. The frequency of the measurement signal MS is then comparatively high, as shown at $MS_D$ in FIG. 6.

Figure 7:
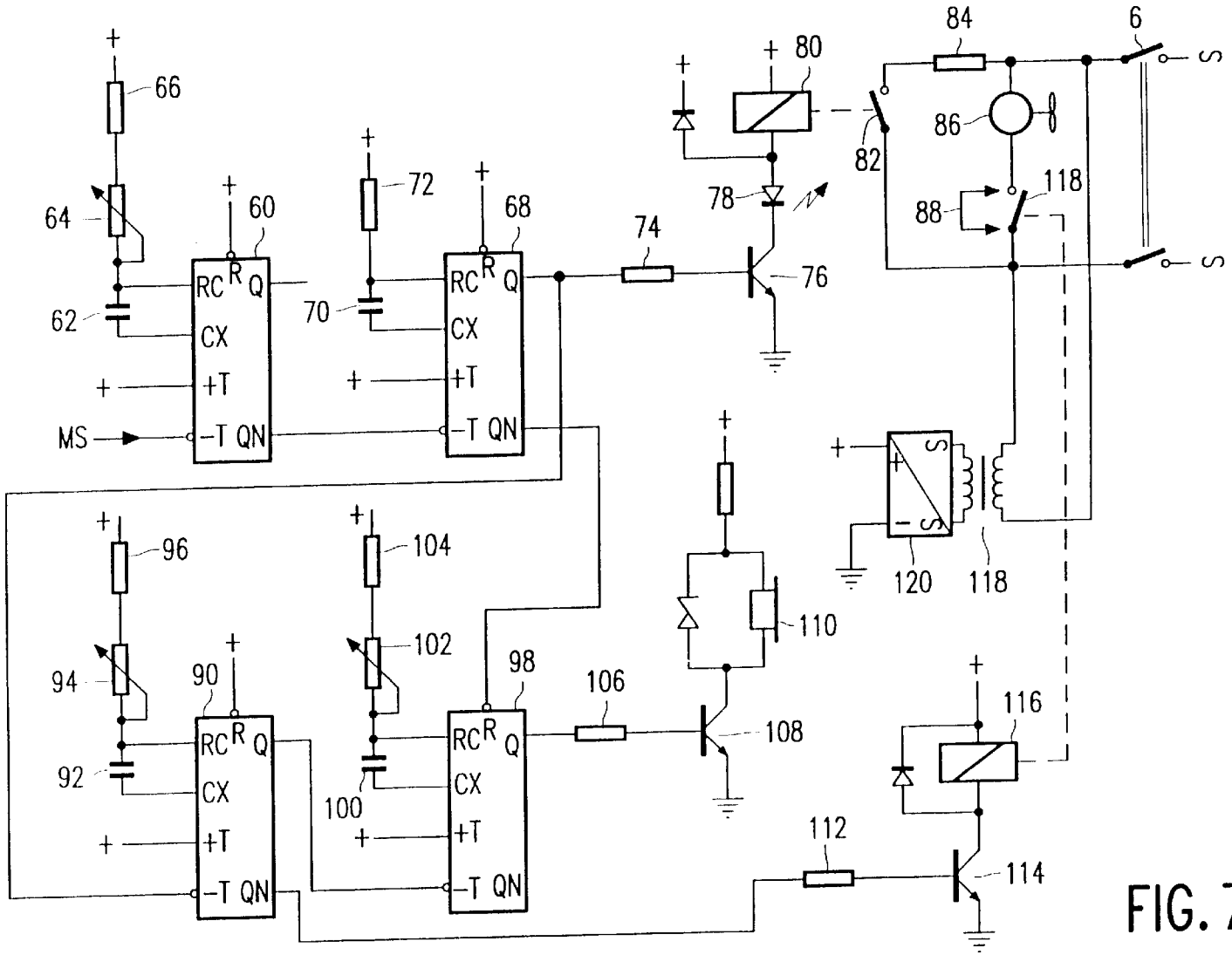
FIG. 7 shows a part of a circuit diagram of an embodiment of a hair-care appliance in accordance with the invention.

The variable frequency of the measurement signal MS is compared with a reference frequency which is representative of a hair moistness at which the heating element of the hair-care appliance should be turned off in order to preclude excessive drying and damage to the hair. FIG. 7 shows a circuit suitable for this purpose. Again, the values given for the resistors and capacitors and the type numbers of the electronic devices are merely given by way of illustration and example. The measurement signal MS is applied to the negative trigger input −T of a first monostable multivibrator 60 of the type HEF 4538, which has its positive trigger input +T and its reset input R connected to the positive supply voltage. The time constant of the monostable multivibrator 60 is determined by a 680 nF capacitor 62 across the terminals CX and RC of the monostable multivibrator 60 and by a variable 100 kΩ resistor 64 and a fixed 39 kΩ resistor 66 between the terminal RC and the positive supply voltage. In the case of a negative signal transient on the negative trigger input −T the output QN will change over from a relatively positive value to a relatively negative value and this state will be sustained for a time determined by the capacitor 62 and the resistors 64 and 66. After this, the output QN will automatically resume the relatively positive value. The output QN of the monostable multivibrator 60 is connected to the negative trigger input −T of a second monostable multivibrator 68, also of the type HEF 4538, which has its positive trigger input +T and its reset input R connected to the positive supply voltage. The time constant of the second monostable multivibrator 68 is determined by a 680 nF capacitor 70 across the terminals CX and RC of the monostable multivibrator 68 and by an 820 kΩ resistor 72 between the terminal RC and the positive supply voltage. The Q output of the second monostable multivibrator 68 drives the base of a switching transistor 76 via a resistor 74, which transistor energizes a relay 80 via an optional LED 78. The relay 80 actuates a switch 82 which connects a heating element 84 to the mains voltage, which can be turned on by means of the switch 6 on the handle.

In the case of a high frequency of the measurement signal MS, i.e. in the case of dry hair, the first monostable multivibrator 60 is triggered so frequently that the output QN remains constantly relatively low. The second monostable multivibrator 68 is then not triggered. However, below a given frequency of the measurement signal, dictated by the capacitor 62 and the resistors 64 and 66, the output QN of the first monostable multivibrator 60 will temporarily go high and then low again, causing the second monostable multivibrator 68 to be triggered. The signal on the output Q of the second monostable multivibrator 68 thus indicates whether the frequency is above or below a given value and this signal controls an electronic switch which turns on and turns off the heating element. As long as the second monostable multivibrator 68 is triggered, i.e. below a given frequency at which the hair is still too moist, the output Q of this second monostable is high, the relay is energized by the transistor 76, and the heating element 84 is energized via the switch 82. When a given frequency is reached, i.e. when the desired degree of moistness is reached, the triggering of the second monostable multivibrator 68 ceases, and the heating element 84 is turned off.

If the hair-care appliance comprises a blower, the blower motor 86 may be connected directly to the mains voltage via a connection 88. The blower is then started when the mains voltage is switched on by means of the switch 6. The LED 78 in series with the relay 80 indicates that the heating element is on. After the heating element has been turned off the blower continues to rotate. The cool air stream then promotes a better fixation of the hair.

The output Q of the second monostable multivibrator 68 is further connected to the negative trigger input −T of a third monostable multivibrator 90, which is also of the type HEF 4538, which has its positive trigger input +T and its reset input R connected to the positive supply voltage. The time constant of the third monostable multivibrator 90 is determined by a 33 μF capacitor 92 across the terminals CX and RC and by a 470 kΩ variable resistor 94 and a 10 kΩ resistor 96 between the terminal RC and the positive supply voltage. The output Q of the third monostable multivibrator 90 is, in its turn, connected to the negative trigger input −T of a fourth monostable multivibrator 98, again of the type HEF 4538, which has its positive trigger input +T connected to the positive supply voltage. The reset input R is connected to the output QN of the second monostable multivibrator 68. The time constant of the fourth monostable multivibrator 98 is determined by a 10 $\mu$F capacitor 100 across the terminals CX and RC and by a 470 kΩ variable resistor 102 and a 10 kΩ resistor 104 between the terminal RC and the positive supply voltage. The output Q of the fourth monostable multivibrator 98 drives the base of a switching transistor 108 via a resistor 106, which transistor energizes a buzzer 110. The buzzer 110 is of a type which produces noise as long as it receives direct voltage.

When the heating element 84 is turned off, the third monostable multivibrator 90, which serves as a timer, is triggered. After a given run-out time determined by the time constant of the third monostable multivibrator 90, the fourth monostable multivibrator 98 is triggered and the buzzer will produce a sound signal during a time determined by the time constant of the fourth monostable multivibrator 98. The buzzer 110 gives the user a signal that the run-out time has expired and that further cooling with cold air is no longer necessary. If desired, an optional circuit may be provided to switch off the blower motor 86 after expiry of the run-out time. For this purpose, the output QN of the third monostable multivibrator 90 drives the base of a switching transistor 114 via a resistor 112, which transistor energizes a relay 116 whose switching contact 118 takes the place of the fixed connection 88.

The converter 30 of FIG. 5 and the circuit of FIG. 7 are energized by means of a transformer 118 and a rectifier 120, which provide the required electrical isolation between the mains voltage and the electrodes 14A/14B.

Obviously, the comparison of the frequency of the measurement signal MS with a reference frequency can also be effected in another way then described hereinbefore. It is, for example, possible to use an FM discriminator which converts the variable frequency into a varying direct voltage and a comparator which compares the direct voltage with a reference voltage. Another possibility is a microprocessor which counts the number of falling edges of the measurement signal MS within a fixed time window.

The measurement circuit shown in FIG. 4 and the embodiment shown in FIGS. 5 and 7 are very suitable for use in hair-care appliances. The resistance variation of the hair is fairly large and the T network provides a high measurement accuracy and an improved immunity to spurious signals. However, the circuit for measuring the hair resistance can also be used for other purposes. Examples of this are measurements of various other resistance values, for example those of NTC and PTC resistors in thermostats, light-sensitive resistors in lighting switches, i.e. uses where a resistance variation is to be monitored.

We claim:

1. A hair-care appliance comprising:

hair-styling means; an electric heating element for heating the hair-styling means; electrodes which enter into contact with the hair to be groomed during use of the hair-care appliance; and a measurement circuit, electrically connected to the electrodes for measuring a resistance value of said hair ($R_x$) obtained by measurement of the resistance of said hair that is in contact with said electrodes and for converting said resistance value into a measurement signal indicative of the moisture content of the hair, wherein the measurement circuit comprises: a voltage source connected between a first terminal and a first electrode of said electrodes; a first resistor connected between the first terminal and a second electrode of said electrodes; a second resistor connected between the second electrode and a second terminal; and a converter for converting a signal current through a current path from the second terminal to the first electrode into the measurement signal.

2. A hair-care appliance as claimed in claim 1, wherein the hair-care appliance further comprises means for comparing the measurement signal with a reference signal, and means for turning off the heating element in response to the comparison.

3. A hair-care appliance as claimed in claim 2, wherein the hair-care appliance comprises a timer for supplying an activation signal to a signaling device after the heating element has been turned off.

4. A hair-care appliance as claimed in claim 3, wherein the hair-care appliance further comprises a blower and means for switching off the blower in response to the activation signal from said timer.

5. A hair-care appliance as claimed in claim 1, wherein the voltage source is an alternating voltage source and the signal current is an alternating current.

6. A hair-care appliance as claimed in claim 2, wherein the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

7. A hair-care appliance as claimed in claim 6, wherein the means for comparing comprise: a first monostable multivibrator having an output and having a trigger input coupled to the output of the comparator; a second monostable multivibrator having an output and having a trigger input coupled to the output of the first monostable multivibrator; and the means for turning off the heating element comprise: an electronic switch having a main current path in series with the heating element and having a control input coupled to the output of the second monostable multivibrator.

8. A hair-care appliance as claimed in claim 5, wherein the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

9. A hair-care appliance as claimed in claim 3, wherein the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

10. A hair-care appliance as claimed in claim 4, wherein the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

11. A hair-care appliance as claimed in claim 2, wherein the voltage source is an alternating voltage source and the signal current is an alternating current.

12. A hair-care appliance as claimed in claim 3, wherein the voltage source is an alternating voltage source and the signal current is an alternating current.

13. A hair-care appliance as claimed in claim 2, wherein the converter comprises: an integrator with a differential amplifier having an inverting input coupled to the second terminal, and with a capacitor connected between an output of the differential amplifier and the inverting input; a comparator having an output connected to the first terminal, having a non-inverting input coupled to the output of the differential amplifier of the integrator via a third resistor and to the output of the comparator via a fourth resistor, and having an inverting input arranged to receive a reference voltage.

* * * * *